US007066584B2

(12) United States Patent
Usui et al.

(10) Patent No.: US 7,066,584 B2
(45) Date of Patent: Jun. 27, 2006

(54) PIEZOELECTRIC INK JET RECORDING HEAD FORMED BY PRESS WORKING

(75) Inventors: Minoru Usui, Nagano-Ken (JP); Tomoaki Takahashi, Nagano-Ken (JP); Tsuyoshi Kitahara, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/969,028

(22) Filed: Oct. 21, 2004

(65) Prior Publication Data

US 2005/0057616 A1 Mar. 17, 2005

Related U.S. Application Data

(62) Division of application No. 10/267,600, filed on Oct. 10, 2002, now Pat. No. 6,952,873, which is a division of application No. 09/481,496, filed on Jan. 12, 2000, now Pat. No. 6,499,836.

(30) Foreign Application Priority Data

Jan. 12, 1999 (JP) ..... 11-4817
Nov. 30, 1999 (JP) ..... 11-340178

(51) Int. Cl.
*B41J 2/045* (2006.01)

(52) U.S. Cl. ..... 347/71

(58) Field of Classification Search ..... 347/68, 347/70, 71
See application file for complete search history.

(56) References Cited

U.S. PATENT DOCUMENTS 5,375,326 A 12/1994 Usui et al. ..... 347/70
5,375,328 A 12/1994 Usui et al. ..... 347/70
5,475,279 A * 12/1995 Takeuchi et al. ..... 347/70
5,748,214 A 5/1998 Usui et al. ..... 347/70

FOREIGN PATENT DOCUMENTS

| | | |
|---|---|---|
| DE | 23 40 855 A1 | 2/1975 |
| EP | 0 829 355 A1 | 3/1998 |
| EP | 0 830 945 | 3/1998 |
| EP | 08345 A1 * | 3/1998 |
| EP | 0 855 275 A2 | 7/1998 |
| JP | 55-14283 | 1/1980 |
| JP | 58-7367 | 1/1983 |
| JP | 4-176655 | 6/1992 |
| JP | 06-238895 | 8/1994 |
| JP | 6-255109 | 9/1994 |
| JP | 06305142 | 11/1994 |
| JP | 06-305142 | 3/1995 |
| JP | 7-156396 | 6/1995 |
| JP | 07-178926 | 7/1995 |
| JP | 9-314836 | 12/1997 |
| JP | 3328609 | 7/2000 |
| WO | 97/37851 | 10/1997 |

* cited by examiner

*Primary Examiner*—K. Feggins
*Assistant Examiner*—Julian D. Huffman
(74) *Attorney, Agent, or Firm*—Wenderoth, Lind & Ponack, L.L.P.

(57) ABSTRACT

An ink jet recording head has an ink passage unit formed by superposing a nozzle plate with a plurality of nozzles and an ink passage plate. The ink passage plate has a plurality of pressure producing chambers connected to the nozzles, and an ink reservoir communicating with the pressure producing chambers by ink inlet ports. A cover plate is joined to a first surface of the ink passage plate. The cover plate is deformed elastically by piezoelectric vibrators so as to apply pressure to the ink contained in the pressure producing chambers.

8 Claims, 11 Drawing Sheets

PIEZOELECTRIC INK JET RECORDING HEAD FORMED BY PRESS WORKING

This is a divisional application of U.S. patent application Ser. No. 10/267,600, filed Oct. 10, 2002, now U.S. Pat. No. 6,952,873, which is a divisional application of U.S. Ser. No. 09/481,496, filed Jan. 12, 2000, now U.S. Pat. No. 6,499,836.

BACKGROUND OF THE INVENTION

1. Field of the Invention

The present invention relates to an ink jet recording head which has pressure producing chambers adapted to be pressurized by a pressure generator to jet ink droplets from nozzles.

2. Description of the Related Art

An ink jet recording head has a plate provided with a plurality of independent nozzles arranged in a row and a plurality of pressure producing chambers arranged in a row and connected to a common ink chamber. The ink jet recording head jets ink droplets from the nozzles by changing the volumes of the pressure producing chambers by piezoelectric vibrators or by vaporizing ink with heating devices.

The pressure producing chambers of the ink jet recording head must be arranged regularly at pitches corresponding to recording density. Therefore, the pressure producing chambers are formed by etching a plate or by an injection molding process using a polymeric material.

When it is desired to form the pressure chambers accurately in the plate by etching, an expensive silicon single crystal must unavoidably be used as the plate and the pressure producing chambers must be formed by anisotropic etching.

Although a plate of a polymeric material provided with pressure producing chamber can relatively easily be formed high accurately by an injection molding process, the plate is liable to be broken due to fatigue caused by repeated cyclic stress induced by piezoelectric vibrators or liable to be deteriorated by repeated heating by the heating devices.

SUMMARY OF THE INVENTION

The present invention has been made in view of the above-mentioned problems and it is therefore an object of the present invention to provide an ink jet recording head excellent in durability and capable of being manufactured at a low manufacturing cost.

According to a first aspect of the present invention, an ink jet recording head comprises an ink passage unit formed by superposing a nozzle plate, an ink passage plate and a cover plate, the nozzle plate being provided with a plurality of nozzles. The ink passage plate has a first surface and a second surface which are opposite to each other, and is provided with a plurality of pressure producing chambers connected to the nozzles respectively and with an ink reservoir communicating with the pressure producing chambers by means of a plurality of ink inlet ports. The cover plate is closely joined to the first surface of the ink passage plate. The ink jet recording head also comprises a pressure generator to apply pressure to an ink in the pressure producing chambers. The ink passage plate is made of a metal sheet having the first surface and the second surface, the ink reservoir is made by forming a through hole from the first surface to the second surface in the metal sheet, and the pressure producing chambers are made by forming a plurality of recesses in the first surface of the metal sheet by press working.

Preferably, the first surface of the metal sheet is subjected to a flattening process after the press working.

Preferably, a plurality of recesses forming the ink inlet ports and the recesses forming the pressure chambers are all formed simultaneously by the press working.

Preferably, the recesses forming the pressure producing chambers and the ink inlet ports are all formed in the first surface of the metal sheet.

Preferably, the recesses forming the ink inlet ports are shallower than the recesses forming the pressure producing chambers.

Preferably, the recesses forming the pressure producing chambers are formed in the first surface of the metal sheet, the recesses forming the ink inlet ports are formed in the second surface of the metal sheet, and the metal sheet is provided with connecting holes which enable the pressure producing chambers to communicate with the ink inlet ports respectively.

Preferably, both the first and the second surfaces of the metal sheet are subjected to a flattening process after the press working.

Preferably, a protuberance-forming recess is formed in the second surface of the metal sheet by the press working so that protruding portions are formed surrounding the recesses forming the pressure producing chambers when the recesses forming the pressure producing chambers are formed in the first surface of the metal sheet by the press working.

Preferably, a plurality of the protuberance-forming recesses formed in the second surface of the metal sheet are formed in a plurality of regions corresponding to a plurality of walls separating the adjacent pressure producing chambers respectively.

Preferably, a plurality of the protuberance-forming recesses formed in the second surface of the metal sheet are formed in a plurality of regions extending across the pressure producing chambers and a plurality of walls separating the adjacent pressure producing chambers respectively.

Preferably, the protuberance-forming recess formed in the second surface of the metal sheet is formed in a single region corresponding to all of the pressure producing chambers.

Preferably, the metal sheet is a sheet of pure nickel, a ternary alloy of zinc, aluminum and copper, or a superplastic alloy of lead, tin and bismuth or the like.

According to a second aspect of the present invention, an ink jet recording head comprises an ink passage unit formed by superposing a nozzle plate, an ink passage plate and a cover plate, the nozzle plate being provided with a plurality of nozzles. The ink passage plate has a first surface and a second surface which are opposite to each other and, is provided with a plurality of pressure producing chambers connected to the nozzles respectively and with an ink reservoir communicating with the pressure producing chambers by means of a plurality of ink inlet ports. The cover plate is closely joined to the first surface of the ink passage plate. The ink jet recording head also comprises a pressure generator to apply pressure to an ink in the pressure producing chambers. The pressure producing chambers are formed as a plurality of recesses formed in the first surface of the ink passage plate, the ink inlet ports are formed as a plurality of recesses formed in the second surface of the ink passage plate, and the ink passage plate is provided with a plurality of connecting holes which enable the pressure producing chambers to communicate with the ink inlet ports.

Preferably, the ink inlet ports and the pressure producing chambers are spaced apart in a direction along a thickness of the ink passage plate and partly overlap each other in a direction perpendicular to the direction along the thickness. The connecting holes are formed in portions of the ink passage plate where the ink inlet ports and the pressure producing chambers overlap each other.

According to a third aspect of the present invention, an ink jet recording head comprises an ink passage unit formed by superposing a nozzle plate, an ink passage plate and a cover plate, the nozzle plate being provided with a plurality of nozzles. The ink passage plate has a first surface and a second surface which are opposite to each other, and is provided with a plurality of pressure producing chambers connected to the nozzles respectively and with an ink reservoir communicating with the pressure producing chambers by means of a plurality of ink inlet ports. The cover plate is closely joined to the first surface of the ink passage plate. The ink jet recording head also comprises a pressure generator to apply pressure to an ink in the pressure producing chambers. The ink passage plate comprises a first sheet having the first surface and a second sheet having the second surface, the first sheet and the second sheet being superposed. The first sheet is provided with a plurality of through holes corresponding to the pressure producing chambers, a through hole corresponding to the reservoir, and a plurality of through holes forming the ink inlet ports. The ink inlet ports enable the through holes corresponding to the pressure producing chambers to communicate with the through hole corresponding to the reservoir. The second sheet is provided with a plurality of recesses forming the pressure producing chambers and a through hole forming the reservoir. The recesses forming the pressure producing chambers are connected to the through holes corresponding to the pressure producing chamber, and the through hole forming the reservoir is connected to the through hole corresponding to the reservoir.

Preferably, the second sheet is made of a metal sheet having a second surface and a third surface which are opposite to each other. The through hole forming the reservoir is formed from the second surface to the third surface in the metal sheet, and the recesses forming the pressure producing chambers are formed in the third surface of the metal sheet by a press working.

Preferably, the third surface of the metal sheet is subjected to a flattening process after the press working.

Preferably, a protuberance-forming recess is formed in the second surface of the metal sheet by the press working so that portions surrounding the recesses forming the pressure producing chambers are protruded when the recesses forming the pressure producing chambers are formed in the third surface of the metal sheet by the press working.

Preferably, a plurality of the protuberance-forming recesses formed in the second surface of the metal sheet are formed in a plurality of regions corresponding to a plurality of walls separating the adjacent pressure producing chambers respectively.

Preferably, a plurality of the protuberance-forming recesses formed in the second surface of the metal sheet are formed in a plurality of regions extending across the pressure producing chambers and a plurality of walls separating the adjacent pressure producing chambers respectively.

Preferably, the protuberance-forming recess formed in the second surface of the metal sheet is formed in a single region corresponding to all of the pressure producing chambers.

Preferably, the metal sheet is a sheet of pure nickel, a ternary alloy of zinc, aluminum and copper, or a superplastic alloy of lead, tin and bismuth or the like.

According to a fourth aspect of the present invention, an ink jet recording head comprises an ink passage unit formed by superposing a nozzle plate, an ink passage plate and a cover plate, the nozzle plate being provided with a plurality of nozzles. The ink passage plate has a first surface and a second surface which are opposite to each other, and is provided with a plurality of pressure producing chambers connected to the nozzles respectively and with an ink reservoir communicating with the pressure producing chambers by means of a plurality of ink inlet ports. The cover plate is closely joined to the first surface of the ink passage plate. The ink jet recording head also comprises a pressure generator to apply pressure to the ink in the pressure producing chambers. The ink passage plate is made of a metal sheet having a first surface and a second surface, the metal sheet comprising a through hole formed from the first surface to the second surface to form the reservoir. A plurality of recesses are formed in the first surface of the metal sheet to form the pressure producing chamber, and a recess is formed in the second surface.

Preferably, a plurality of the recesses formed in the second surface of the metal sheet are formed in a plurality of regions corresponding to a plurality of walls separating the adjacent pressure producing chambers respectively.

Preferably, a plurality of the recesses formed in the second surface of the metal sheet are formed in a plurality of regions extending across a plurality of walls separating the adjacent pressure producing chambers and the pressure producing chambers respectively.

Preferably, the recess formed in the second surface of the metal sheet is formed in a single region corresponding to all of the pressure producing chambers.

Preferably, the metal sheet is a sheet of pure nickel, a ternary alloy of zinc, aluminum and copper, or a superplastic alloy of lead, tin and bismuth or the like.

In the ink jet recording heads according to the first, second, third and fourth aspects of the present invention, it is preferable that the ink passage plate is provided with ink outlet holes in portions of bottom walls of the pressure producing chambers corresponding to the nozzles so as to connect the pressure producing chambers to the nozzles respectively.

In the ink jet recording heads according to the first, second, third and fourth aspects of the present invention, it is preferable that the cover plate is an elastic plate which is capable of being deformed at least in portions corresponding to the pressure producing chambers respectively. The pressure generator includes a plurality of piezoelectric vibrators which are capable of deforming the elastic plate.

According to the first aspect of the present invention, the ink passage plate is formed by forming a through hole for forming the reservoir and the recesses for forming the pressure producing chambers in the metal sheet by press working. Therefore, the pressure producing chambers of the ink passage plate, which significantly affect the ink jetting performance of the ink jet recording head, can accurately be formed in a desired size.

According to the second aspect of the present invention, the recesses forming the pressure producing chambers are formed in one of the surfaces of the ink passage plate and the recesses forming the ink inlet ports are formed in the other surface of the ink passage plate. Therefore, the recesses forming the pressure producing chambers and those forming the ink inlet ports can simultaneously be formed by press working using a pair of dies. Each of the pair of dies need not be provided with projections differing from each other in height and, consequently, accurate press working can be achieved.

According to the third aspect of the present invention, the first sheet provided with the through holes forming the ink inlet ports and the second sheet provided with recesses forming the pressure producing chambers are superposed to form the ink passage plate. Therefore, the ink inlet ports having a sectional shape of a desired shape can accurately be formed.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

First Embodiment

Figure 1:
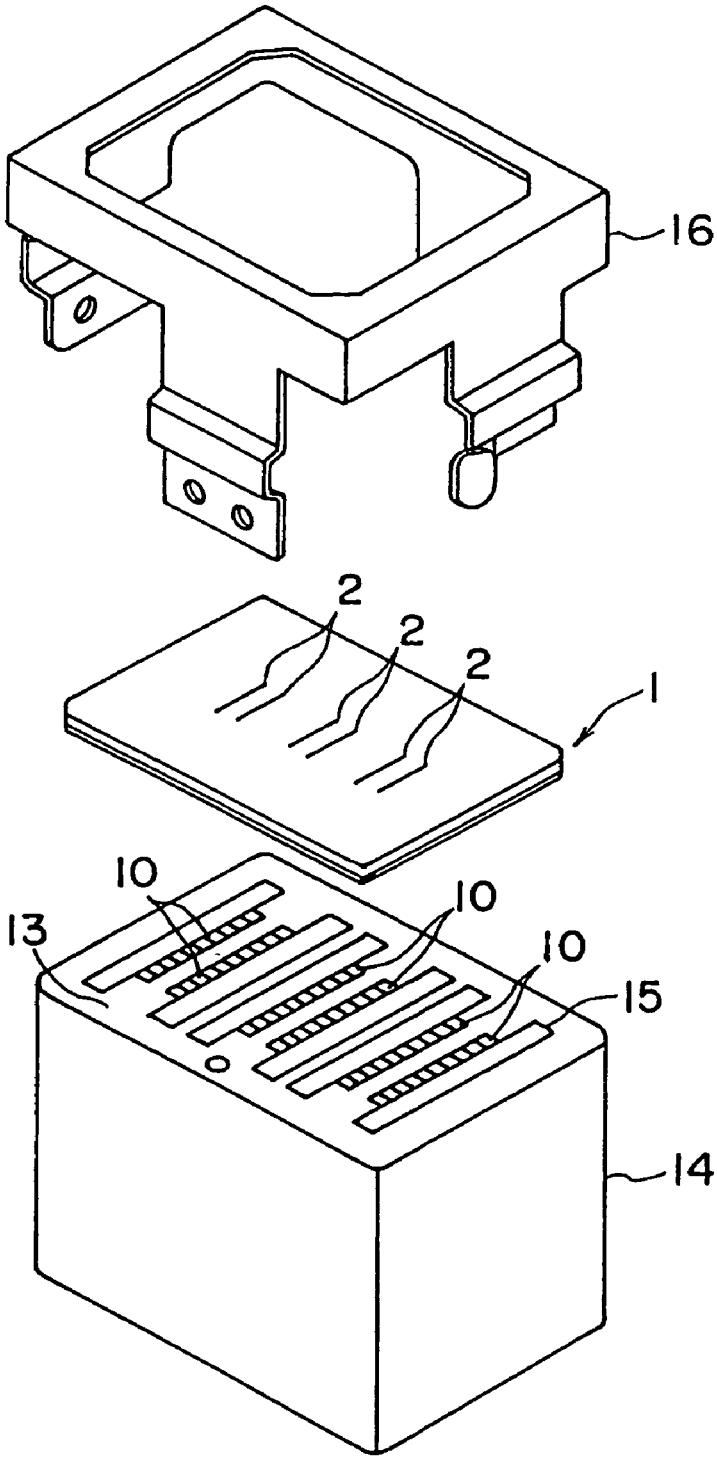
FIG. 1 is an exploded perspective view of an ink jet recording head in a first embodiment according to the present invention.
Figure 2:
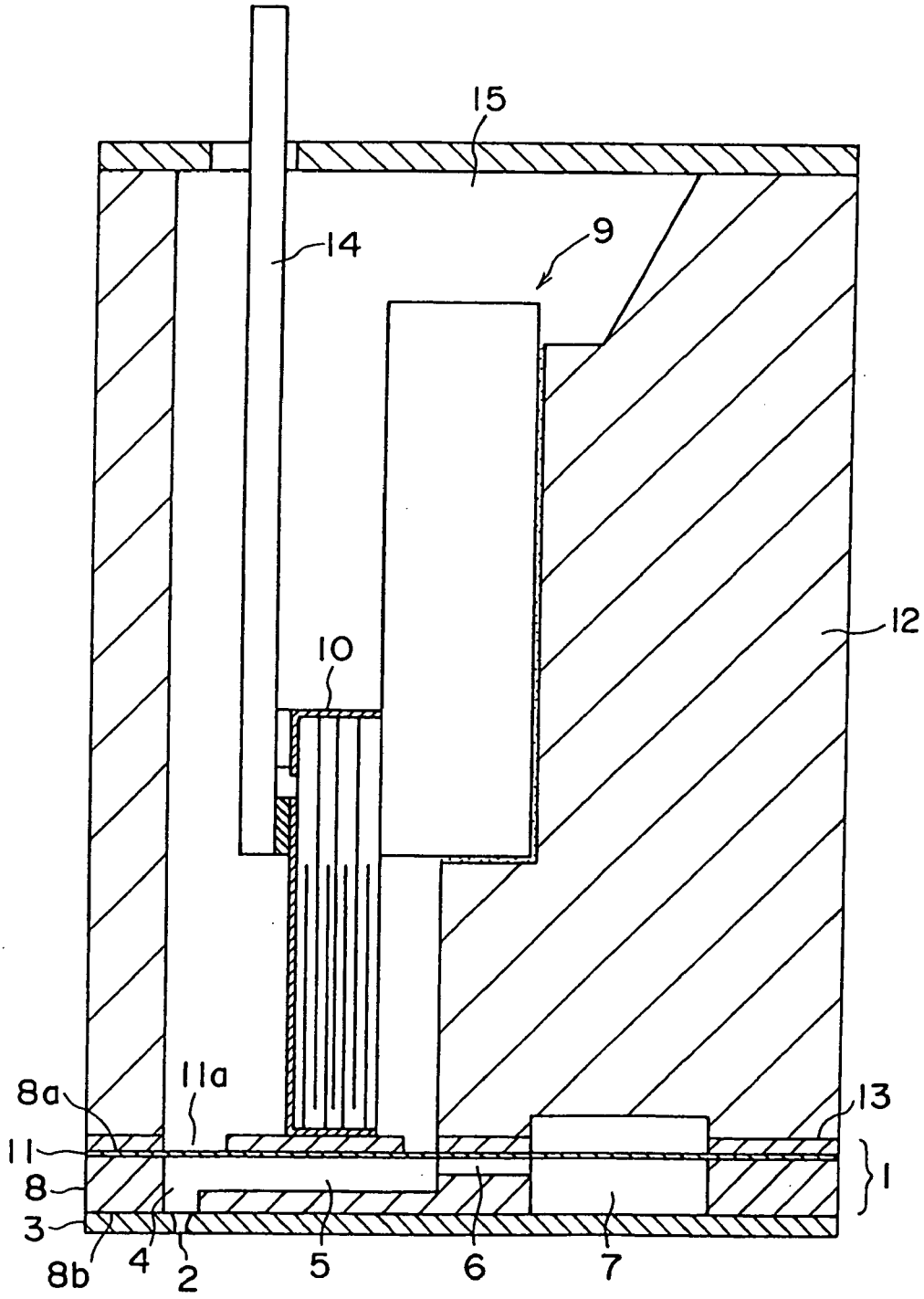
FIG. 2 is a sectional view of the ink jet recording head shown in FIG. 1.

Referring to FIGS. 1 and 2 showing an ink jet recording head in a first embodiment according to the present invention, an ink passage unit 1 comprises a nozzle plate 3 provided with a plurality of nozzles 2 formed therein at predetermined pitches. An ink passage plate 8 has pressure producing chambers 5 and ink outlet holes 4 connecting the pressure producing chambers 5 to the nozzles 2 respectively. A reservoir 7 supplies ink to the pressure producing chambers 5, and ink inlet ports 6 connect the reservoir 7 to the pressure producing chambers 5. An elastic cover plate 11 is driven by piezoelectric vibrators 10 that vibrate in a longitudinal vibration mode to vary the volumes of the pressure producing chambers 5. The nozzle plate 3, the ink passage plate 8 and the cover plate 11 are superposed and united together in that order. Tips of the piezoelectric vibrators 10 are in contact with the elastic cover plate 11.

Figure 3:
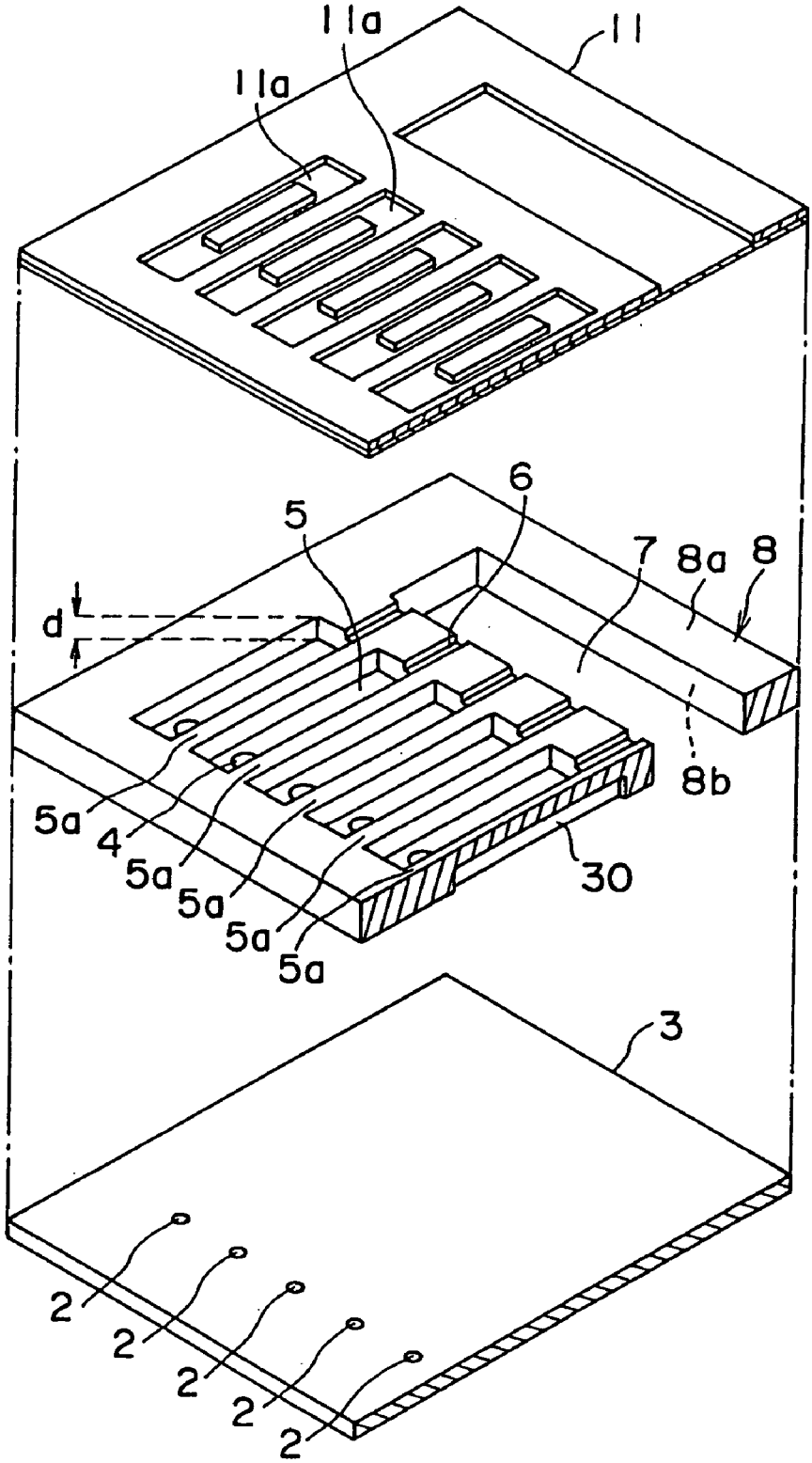
FIG. 3 is an exploded perspective view of an ink passage unit included in the ink jet recording head shown in FIG. 1.

Since the piezoelectric vibrators 10 are employed as the pressure generators, the thickness of portions of the elastic cover plate 11 corresponding to the pressure producing chambers 5 is reduced to form thin portions 11*a* as shown in FIG. 3 such that the thin portions 11*a* can elastically be deformed by the piezoelectric vibrators 10. If the ink jet recording head is provided with heating devices for heating and vaporizing the ink to produce pressure in the pressure producing chambers 5, it is desirable to use a rigid cover plate instead of the elastic cover plate 11.

The ink jet recording head is assembled by attaching the ink passage unit 1 to an open end 13 of a holder 12 formed of a polymeric material by injection molding or the like. A piezoelectric vibrating unit 9 is placed in a space 15 formed in the holder 12 after connecting a flexible cable 14 to the piezoelectric unit 9. The piezoelectric vibrating unit 9 is bonded to inner surfaces of the holder 12 with an adhesive, and a frame 16 serving as an electrostatic shield is placed on the holder 12. Drive signals are transmitted through the flexible cable 14 to the piezoelectric vibrating unit 9.

Referring to FIG. 3 showing the ink passage unit 1 in an exploded perspective view, the ink passage plate 8 is formed of a material having a superplastic property and resistant to the ink, such as a sheet of pure nickel having a thickness slightly greater than the depth d of pressure producing chambers 5 to be formed therein. The ink passage plate 8 is provided with pressure producing chambers 5 of the depth d, a through hole for forming a reservoir 7, and recesses for forming ink inlet ports 6 extending between the through hole for forming the reservoir 7 and the recesses for forming the pressure producing chambers 5. The ink outlet holes 4 are formed in portions of the recesses for forming the pressure producing chambers 5 corresponding to the nozzles 2, respectively, by a laser-beam machining or the like.

The ink passage plate 8 thus formed has a first surface 8*a* in which the recesses forming the pressure producing chambers 5 are formed and a second surface 8*b* which is opposite to the first surface 8*a*, The nozzle plate 3 is bonded to the second surface 8*b* of the ink passage plate 8 with an adhesive or the like such that the nozzles 2 are aligned with the ink outlet holes 4. The cover plate 11 is bonded to the first surface 8*a* of the ink passage plate 8 with an adhesive or the like.

A method of fabricating the ink passage plate 8 will be described with reference to FIGS. 4 to 7.

Figure 4:
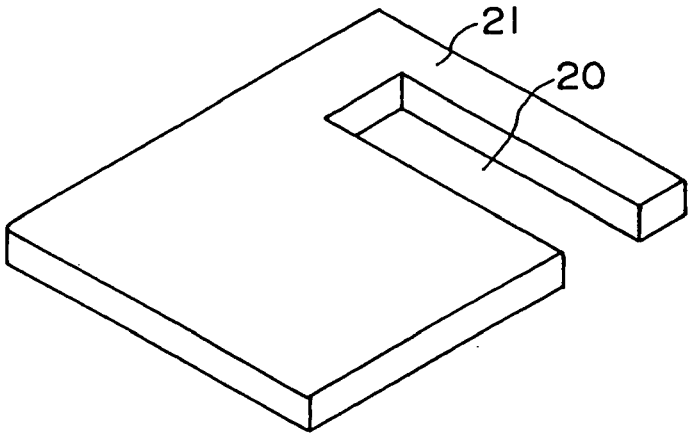
FIG. 4 is a perspective view of a sheet employed in fabricating the ink passage unit shown in FIG. 3.
Figure 6A:
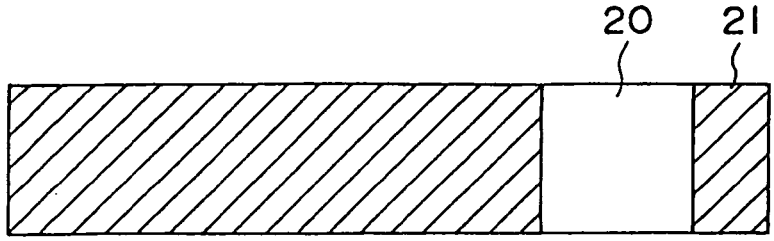
FIGS. 6A to 6E are sectional views of the sheet in different phases of a sheet shaping process.

In a first step shown in FIG. 6A, a through hole 20 for forming the reservoir 7 is formed in a sheet 21 as shown in FIG. 4.

Figure 5A:
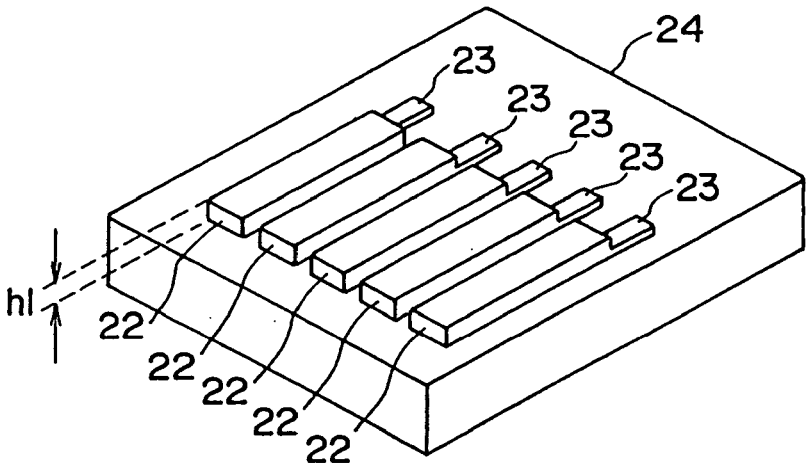
FIGS. 5A and 5B are perspective views of a first die and a second die for processing the sheet shown in FIG. 4, respectively, by press working.
Figure 5B:
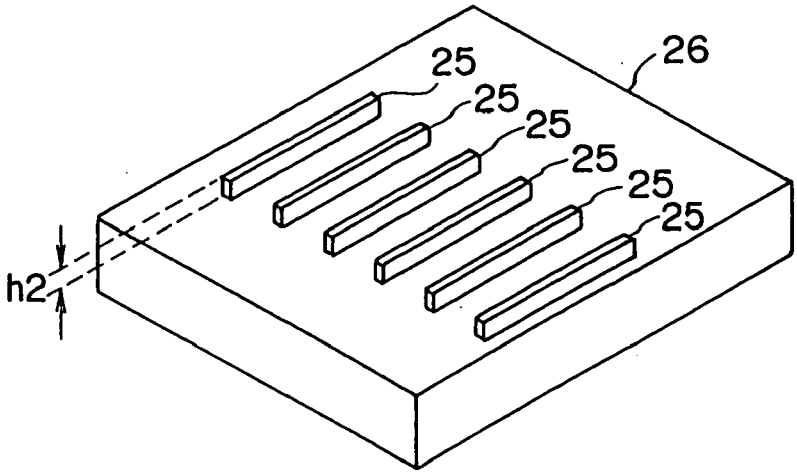
Figure 6B:
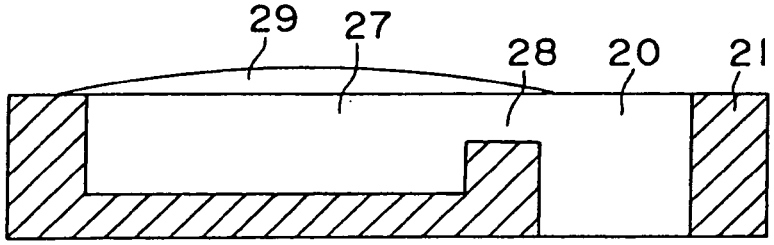
Figure 6C:
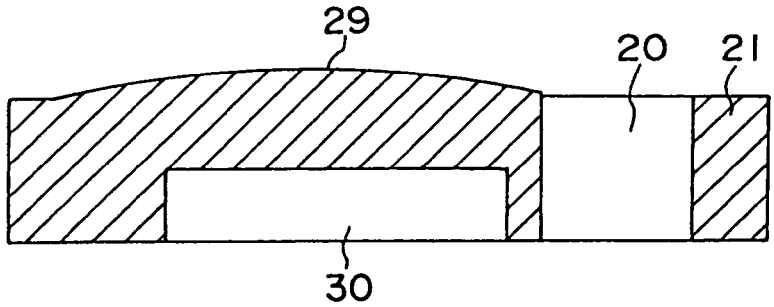
Figure 7A:
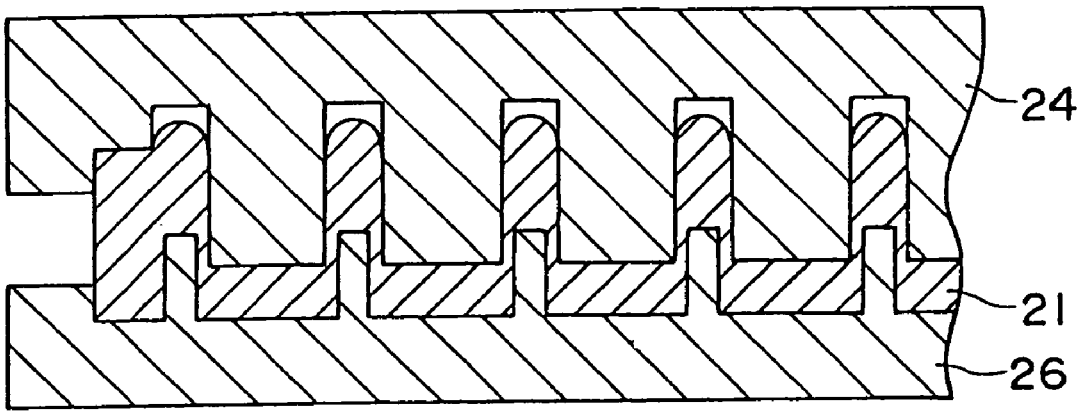
FIGS. 7A and 7B are sectional views of the sheet in different phases of the sheet shaping process.
Figure 7B:
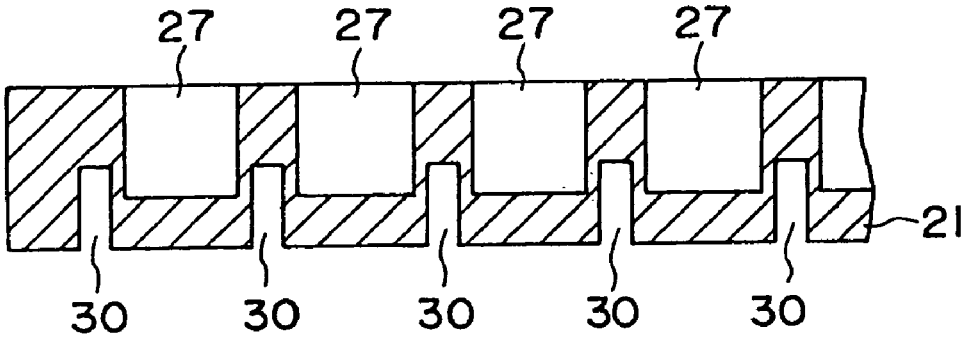

In a second step shown in FIGS. 6B and 6C, the sheet 21 is subjected to press working using a first die 24 shown in FIG. 5A and a second die 26 shown in FIG. 5B to shape the sheet 21 in a shape as shown in FIG. 7A. The first die 24 is provided with a plurality of projections 22 and 23 for forming the recesses which will form the pressure producing chamber 5 and the ink inlet ports 6. The second die 26 is provided with a plurality of projections 25 for forming the walls 5*a* lying between the adjacent pressure producing chambers 5 and extending between the ink outlet hole 4 and the ink inlet port 6. The projections 22 have a height h, slightly greater than the depth d of the pressure producing chambers 5.

In the second step, i.e., a shaping step, a plurality of recesses 27 and a plurality of recesses 28 which form the pressure producing chambers and the ink inlet ports 6, respectively, are formed by the projections 22 and 23 of the first die 24, and a plurality of recesses (protuberance-forming recesses) 30 corresponding to the walls 5*a* lying between the adjacent pressure producing chambers 5 are formed by the projection 25 of the second die 26. Thus, portions of the back (second) surface of the sheet 21 are depressed in the recesses 30 and, consequently, slightly protruded portions 29 are formed in portions of the surface of the sheet 21 corresponding to the walls 5*a* lying between the pressure producing chambers 5 as shown in FIGS. 6B, 6C and 7A. The recesses 30 formed in the back (second) surface prevents shear droop in boundary portions of the sheet 21 between the adjacent recesses 27 when forming the recesses 27 with the projections 22 of the first die 24.

Figure 6D:
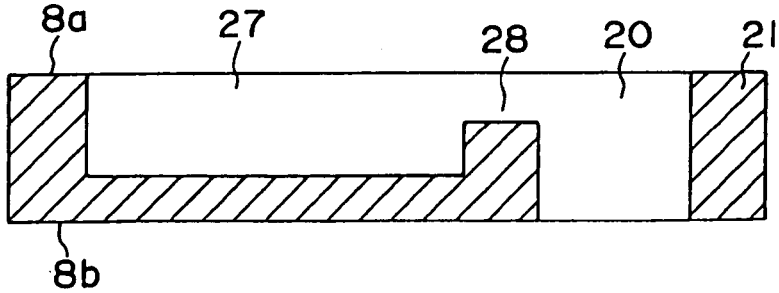

In a third step shown in FIG. 6D, the slightly protruded portions 29 formed on the surface in which the recesses 27 are formed (i.e., the first surface 8*a* of the ink passage plate 8) are flattened by rubbing or the like. Consequently, the surfaces of walls between the adjacent recesses 27 which form the pressure producing chambers 5 are flattened. Since the slightly protruded portions 29 are small and are formed only on the walls 5*a* between the pressure producing chambers 5, the slightly protruded portions 29 can easily be removed by grinding or the like to flatten the first surface 8*a* in which the recesses 27 and 28 are formed.

Figure 6E:
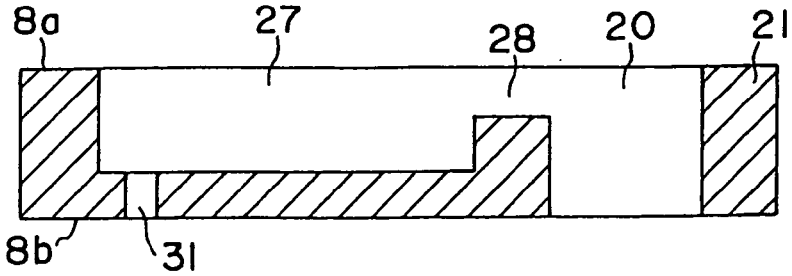

In a fourth step, minute through holes 31, which serve as the ink outlet holes 4, are formed as shown in FIG. 6E by a minute hole forming technique, such as laser-beam machining.

The nozzle plate 3 and the elastic cover plate 11 are bonded to the opposite surfaces of the ink passage plate 8 with an adhesive or a fusible film to complete the ink passage unit 1. Since the surfaces of the walls 5*a* between the recesses 27 forming the pressure producing chambers 5 are ground flat, the cover plate 11 can surely and closely be bonded to the first surface 8*a*, The pressure producing chambers 5 are connected to the nozzles 2 by the ink outlet holes 4 with reliability.

Figure 8:
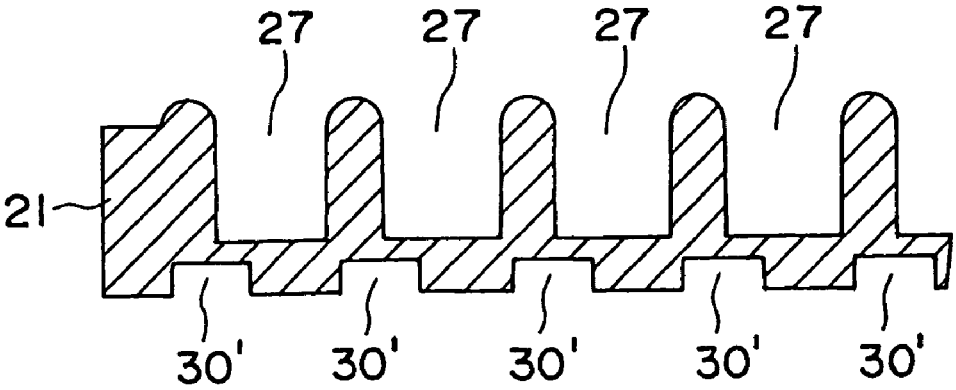
FIG. 8 is a sectional view of a sheet employed in an ink jet recording head in a first modification of the ink jet recording head shown in FIG. 1.

In this embodiment, the recesses 30 are formed in the portions in which the slightly protruded portions 29 corresponding to the walls 5*a* between the adjacent pressure producing chambers 5 are formed. An ink jet recording head in a first modification of the ink jet recording head of the first embodiment employs an ink passage plate formed by processing a sheet 21 as shown in FIG. 8. As shown in FIG. 8, a recess 30' is formed in a portion of each recess 27 nearer to the recesses 28 which form the ink inlet port 6 than a portion near the hole 31 that serves as the ink outlet port 4 so as to extend across a portion corresponding to the wall 5*a* (FIG. 3) and the recess 27.

Figure 9A:
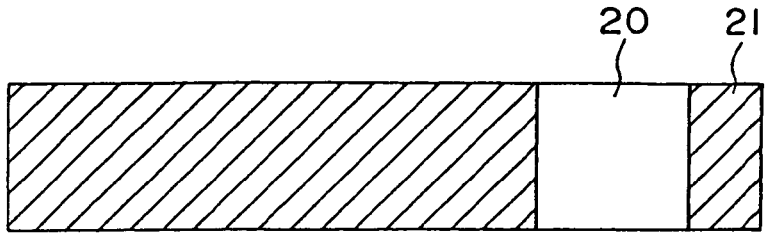
FIGS. 9A to 9E are sectional views of the sheet in different phases of a sheet employed in an ink jet recording head in a second modification of the ink jet recording head shown in FIG. 1.
Figure 9B:
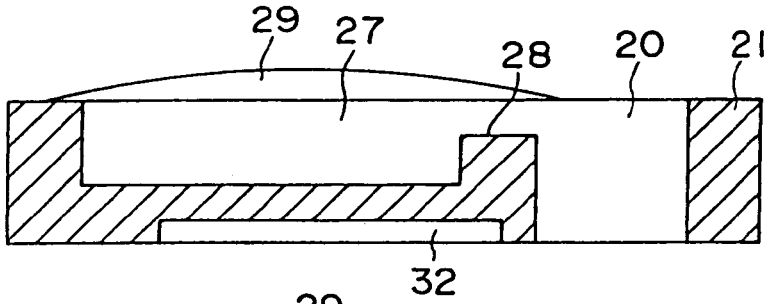
Figure 9C:
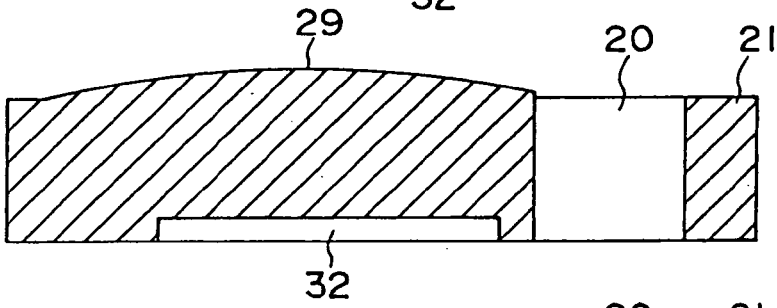

An ink jet recording head in a second modification of the ink jet recording head of the first embodiment employs an ink passage plate formed by shaping a sheet 21 as shown in FIGS. 9A to 9E. This ink passage plate is fabricated by the following method. A through hole 20 for forming the reservoir 7 is formed in a sheet 21 as shown in FIG. 9A. Then, the sheet 21 is shaped by press working using a first die 24 shown in FIG. 10A provided with a plurality of projections 22 and 23 for forming recesses which form the pressure producing chambers 5 and the ink inlet ports 6 similar to the first die 24 shown in FIG. 5A. A second die 26' shown in FIG. 10B provided with a single projection 25' forms a recess in a portion of the sheet 21 between the ink outlet holes 4 and the ink inlet ports 6 and corresponding to a region where the plurality of pressure producing chambers 5 are all formed.

The height $h_3$ of the projection 25' (FIG. 10B) is smaller than the height $h_2$ of the projection 25 of the second die 26 shown in FIG. 5B so that the bottom walls of the pressure producing chambers 5 can be formed.

Figure 11A:
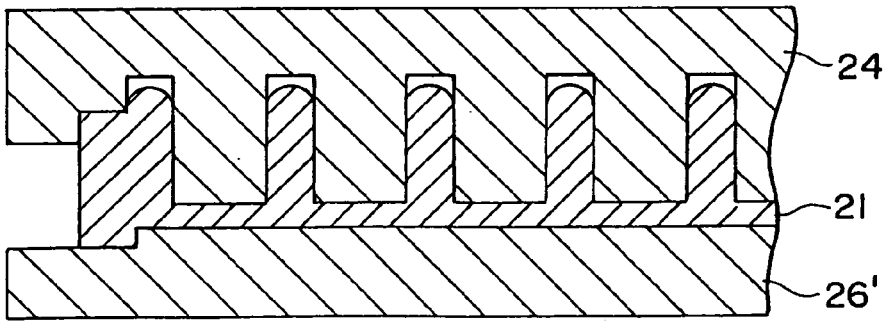
FIGS. 11A and 11B are sectional views of a sheet in a sheet forming process in manufacturing the ink jet recording head in the second modification of the ink jet recording head shown in FIG. 1.

The plurality of recesses 27 and 28 which form the pressure producing chambers 5 and the ink inlet ports 6 are formed with the projections 22 and 23 of the first die 24. The single recess 32 corresponding to all of the pressure producing chambers 5 is formed with the projection 25' of the second die 26' by press working. A portion of the back surface of the sheet 21 is depressed in the recess 32 and, consequently, slightly protruded portions 29 are formed in portions of the surface of the sheet 21 and form the walls 5*a* lying between the recesses 27 which form the pressure producing chambers 5 as shown in FIGS. 9B, 9C and 11A. The recess 32 formed in the second surface 8*b* prevents shear droop in boundary portions of the sheet 21 between the adjacent recesses 27 when forming the recesses 27 with the projections 22 of the first die 24.

Figure 9D:
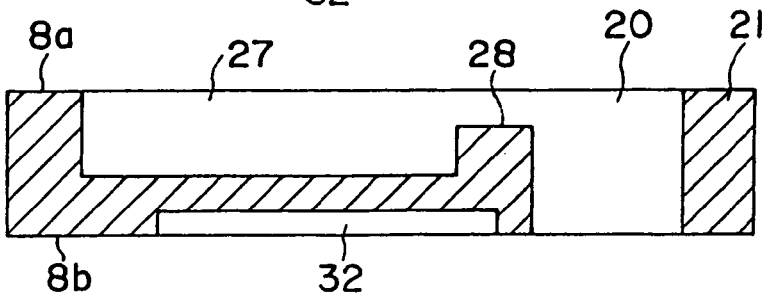
Figure 9E:
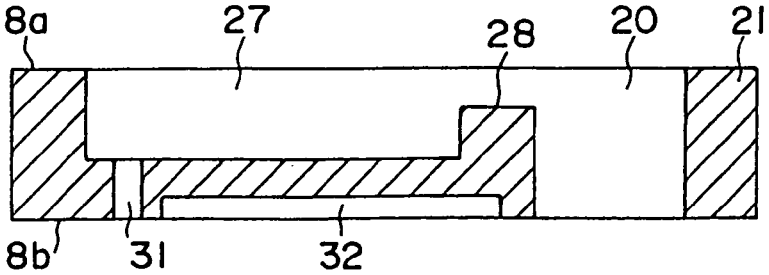
Figure 10A:
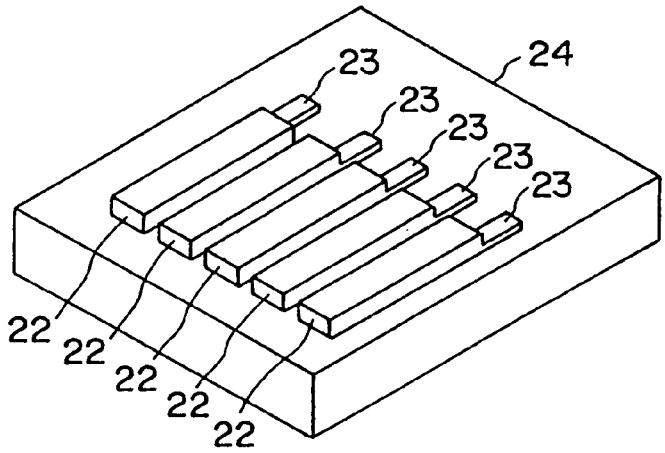
FIGS. 10A and 10B are perspective views of a first die and a second die for pressing a sheet in manufacturing the ink jet recording head in the second modification of the ink jet recording head shown in FIG. 1.
Figure 10B:
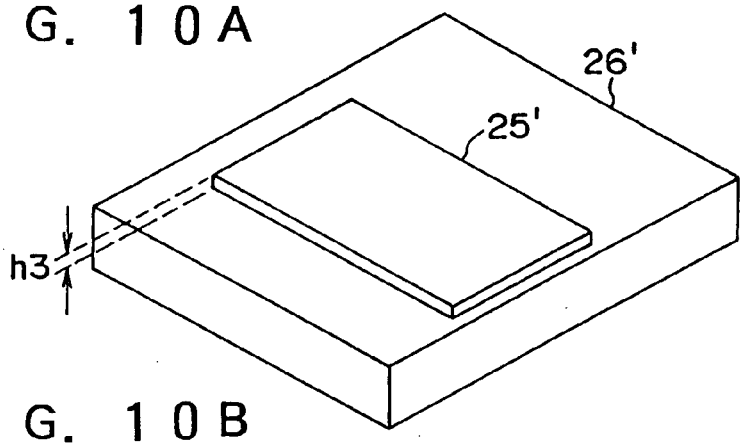
Figure 11B:
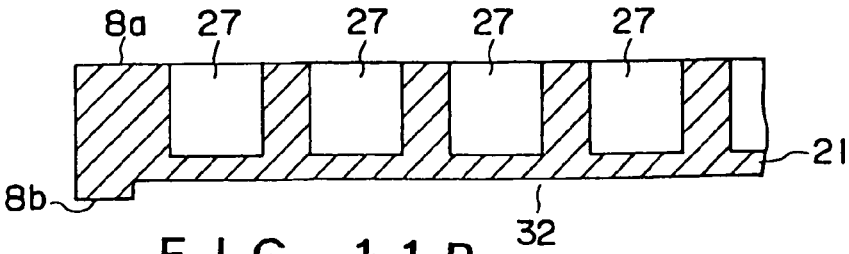

Then, as shown in FIGS. 9D and 11B, the slightly protruded portions 29 formed on the first surface 8*a* of the sheet 21 are flattened by rubbing or the like. Then, minute through holes 31, which serve as the ink outlet holes 4, are formed in portions of the sheet 21 corresponding to the nozzles 2 as shown in FIG. 9E.

In the ink jet recording head in the first embodiment and the modifications thereof, the sheet 21 forming the ink passage plate 8 is a sheet of pure nickel. A sheet of a ternary alloy of zinc, aluminum and copper or a sheet of a superplastic alloy of lead, tin and bismuth may be used as the sheet 21.

Second Embodiment

Figure 12A:
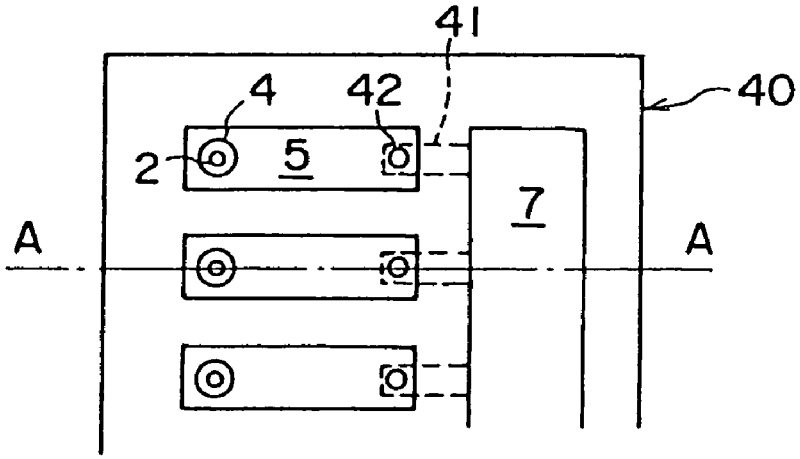
FIG. 12A is a plan view of an essential portion of an ink jet recording head in a second embodiment according to the present invention.
Figure 12B:
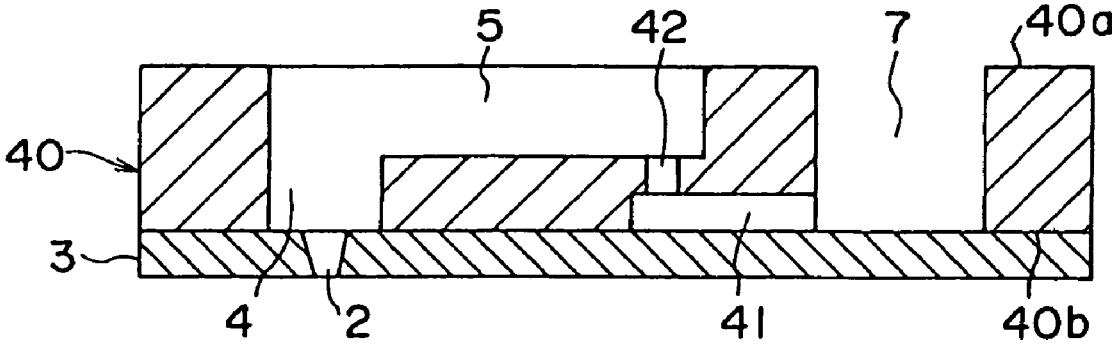
FIG. 12B is a sectional view taken on line A—A in FIG. 12A.

An ink jet recording head in a second embodiment according to the present invention will be described with reference to FIGS. 12 and 13, in which parts corresponding to those of the ink jet recording head in the first embodiment are denoted by the same reference characters and the description thereof will be omitted.

The ink jet recording head in the second embodiment is provided with an ink passage plate 40 different from the ink passage plate 8 of the ink jet recording head in the first embodiment. The ink passage plate 40 is provided with a plurality of recesses forming a plurality of ink inlet ports 41 which are formed in a second surface 40*b*, i.e., a surface to which a nozzle plate 3 is attached.

The ink inlet ports 41 and corresponding pressure producing chambers 5 are spaced apart which respect to a thickness direction of the ink passage plate 41, and partly overlap each other with respect to a longitudinal direction perpendicular to the thickness direction. Connecting holes 42 are formed in portions of the ink passage plate 41 where the ink inlet ports 41 and the corresponding pressure producing chambers 5 overlap each other so as to connect the ink inlet ports 41 to the corresponding pressure producing chambers 5, respectively. A reservoir 7 communicates with the pressure producing chambers 5 by means of the ink inlet ports 41 and the connecting holes 42 to supply the ink to the pressure producing chambers 5.

Figure 13A:
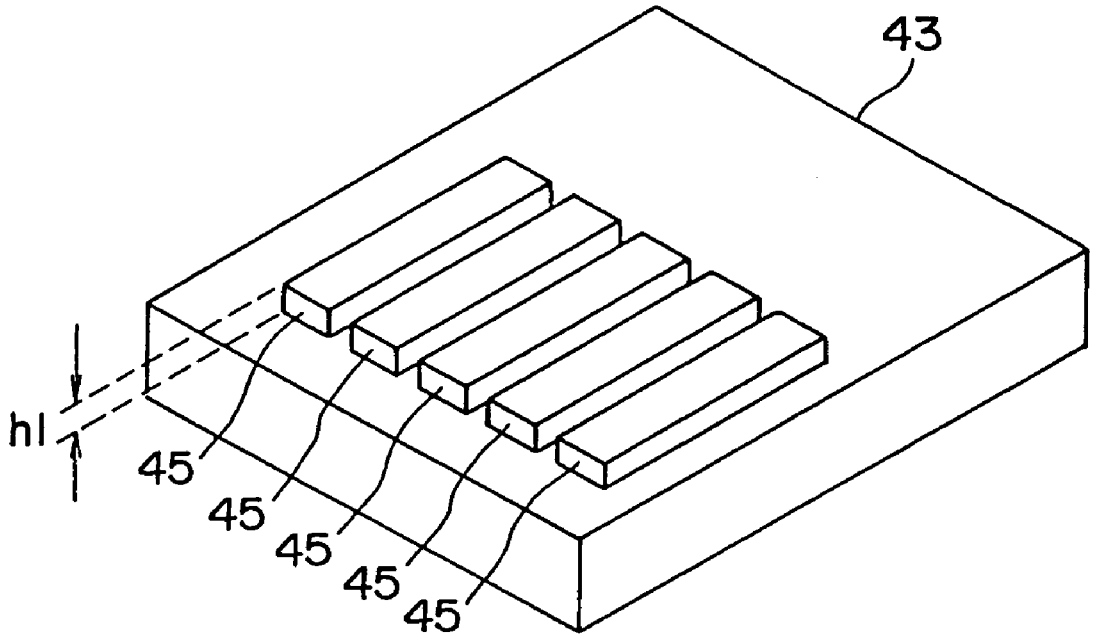
FIGS. 13A and 13B are perspective views of a first die and a second die for pressing the plate shown in FIG. 4 and employed in the second embodiment.
Figure 13B:
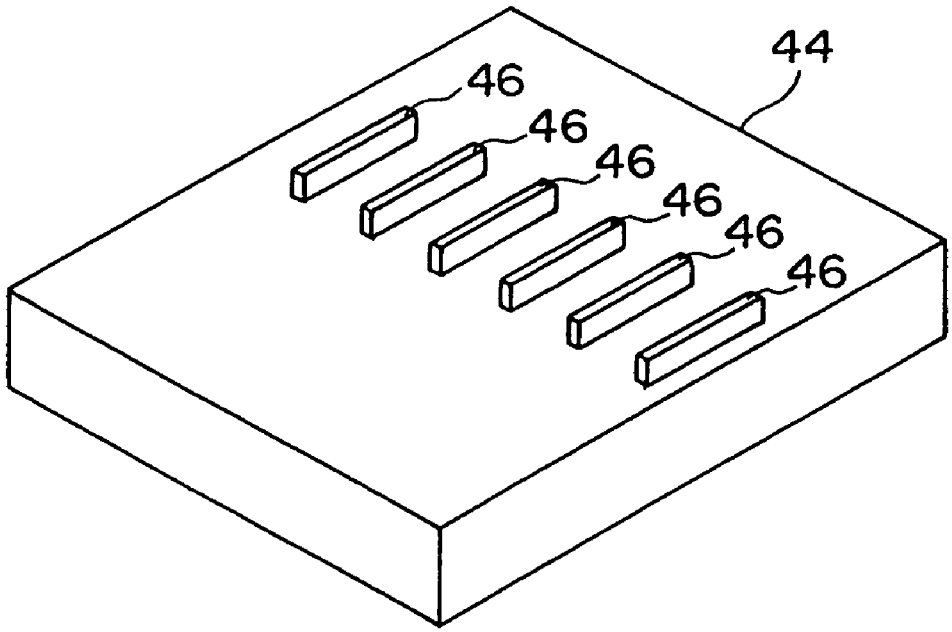

A method of fabricating the ink jet recording head in the second embodiment will be described with reference to FIGS. 13A and 13B. In the second embodiment, the same sheet 21 shown in FIG. 4 is used as in the first embodiment. The sheet 21 with the through hole 20 for the reservoir 7 is shaped by press working using a pair of dies, i.e., a first die 43 shown in FIG. 13A and a second die 44 shown in FIG. 13B, and the opposite surfaces of the shaped sheet 21 are flattened by a flattening process. The first die is provided with a plurality of projections 45 for forming recesses which form the plurality of pressure producing chambers 5 as shown in FIG. 13A. The first die 43 is not provided with any projections corresponding to the projections 23 of the first die 24 shown in FIG. 5A used for fabricating the ink jet recording head in the first embodiment. The second die 44 is provided with a plurality of projections 46 for forming the plurality ink inlet ports 41 as shown in FIG. 13B. The second die 44 is not provided with any projections corresponding to the projections 25 shown in FIG. 5B. The second die 44 may be provided with projections capable of a function similar to that of the projections 25 in portions thereof which do not interfere with the projections 46. The sheet 21 is compressed between the first die 43 and the second die 44 for press working to form the plurality of recesses for forming the plurality pressure producing chambers 5, and the plurality of recesses for forming the plurality of ink inlet ports 41 simultaneously. The sheet 21 is subjected to a flattening process to flatten the opposite surfaces thereof after the completion of press working.

In the second embodiment, the recesses for forming the pressure producing chambers 5 are formed in the first surface 40*a* of the ink passage plate 40, and the recesses for forming the ink inlet ports 41 are formed in the second surface 40*b* of the ink passage plate 40. Thus, it is unnecessary to form the recesses respectively having different depths simultaneously in one of the surfaces of the sheet 21. As obvious from FIG. 5A, the first die 24 employed in fabricating the ink jet recording head in the first embodiment is provided with the projections 22 and 23 differing from each other in height because the sectional area of the ink inlet ports 6 must be smaller than that of the pressure producing chambers 5 to limit the reverse flow of the ink to the least amount when pressure is applied to the ink contained in the pressure producing chambers 5. It is desired to form the pressure producing chamber so it has a large sectional area (great depth) to reduce the resistance against the flow of the ink and to enhance the response characteristic. In some cases, it is difficult to achieve accurate press working by using a die having projections differing from each other in height. If the projections 22 and 23 are formed so as to have the same height, the projections 23 for forming the recesses forming the ink inlet ports 6 must be formed in a width smaller than that of the projections 22 for forming the recesses for forming the pressure producing chambers 5. However, the projections 23 having a small width makes accurate press working difficult.

In the second embodiment, the recesses forming the pressure producing chambers 5 and those forming the ink inlet ports 6 are formed in the different surfaces of the ink passage plate 40, respectively. Therefore, projections respectively having different heights need not be formed in each of the dies and hence accurate press working can be achieved.

Third Embodiment

An ink jet recording head in a third embodiment according to the present invention will be described with reference to FIG. 14, in which parts corresponding to those of the ink jet recording head in the first embodiment are denoted by the same reference characters and the description thereof will be omitted.

Figure 14A:
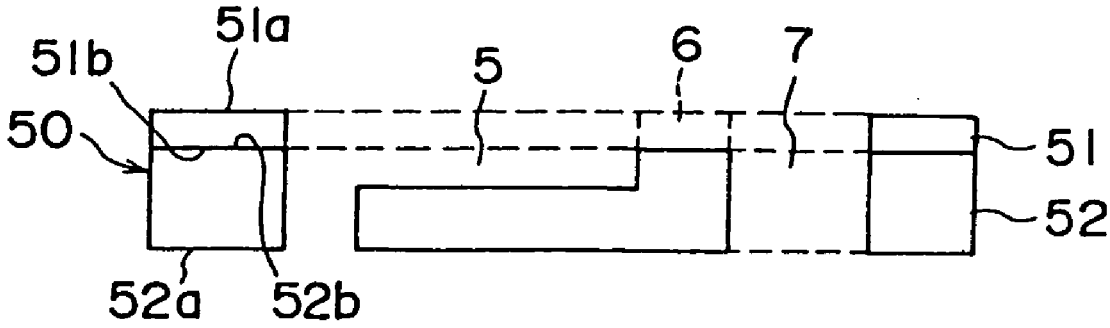
FIG. 14A is a sectional view of an essential portion of an ink jet recording head in a third embodiment according to the present invention.
Figure 14B:
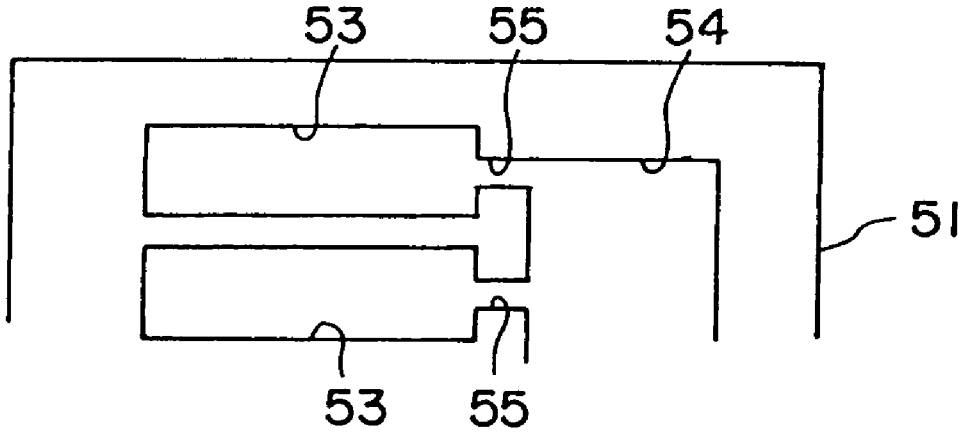
FIG. 14B is a plan view of a first sheet and 14C is a plan view of a second sheet.
Figure 14C:
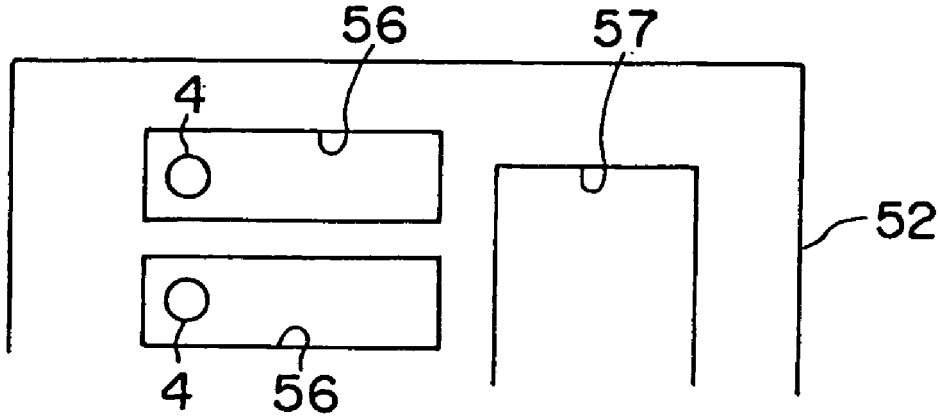

The ink jet recording head in the third embodiment is provided with an ink passage plate 50 different from the ink passage plate 8 of the ink jet recording head in the first embodiment. As shown in FIG. 14A, the ink passage plate 50 is formed by superposing and uniting together a first sheet 51 shown in FIG. 14B and a second sheet 52 shown in FIG. 14C. The first sheet 51 is provided with a plurality of through holes 53 for forming a plurality of pressure producing chambers 5, a through hole 54 for forming a reservoir 7, and a plurality of through holes 55 for forming a plurality of ink inlet ports 6, connecting the through holes 53 to the through hole 54. The second sheet 52 is provided with a plurality of recesses 56 to be combined with the plurality of through holes 53 to form the plurality of pressure producing chambers 5, and a through hole 57 to be combined with the through hole 54 to form the reservoir 7. The second sheet 52 is provided with ink outlet holes 4 at positions corresponding to nozzles 2 in portions of the recesses 56 for forming the pressure producing chambers 5.

A method of fabricating the ink jet recording head in the third embodiment will be described hereinafter. As viewed in FIGS. 14A to 14C, the upper surface of the first sheet 51 is referred to as a first surface 51*a*, the lower surface of the second sheet 52 is referred to as a second surface 52*a*, the upper surface of the second sheet 52 is referred to as a third surface 52*b*, and the lower surface of the first sheet 51 is referred to as a fourth surface 51*b*.

The through holes 53, 54 and 55 of predetermined shapes are formed in the first sheet 51 having the first surface 51*a* and the fourth surface 51*b*, i.e., a metal sheet, by a punching process or an etching process. The thickness of the first sheet 51 determines the sectional area of the ink inlet ports 6. The through hole 54 of a predetermined shape forming the reservoir 7 is formed from the second surface 52*a* to the third surface 52*b* of the second sheet 54, i.e., a metal sheet. The recesses 56 forming the pressure producing chambers 5 are formed in the third surface 52*b* of the second sheet 52 by press working, and then the third surface 52*b* of the second sheet 52 is flattened by a flattening process, such as a rubbing process or the like. The ink outlet holes 4 are formed in portions of the second sheet 52 corresponding to the nozzles 2 by laser-beam machining or the like.

The first sheet 51 with the through holes 55 defining the ink inlet ports 6, and the second sheet 52 with the recesses 56 forming the pressure producing chambers 5 are superposed and united together to form the ink passage plate 50. The sectional area of the ink inlet ports 6 is determined by the thickness of the first sheet 51 and the width of the through holes 55. Thus, the ink inlet ports 6 can accurately be formed in a section of a desired size. Since the recesses 56 forming the pressure producing chambers 5 are formed by press working, the pressure producing chambers 5 can accurately be formed in a desired size.

The pressure generator of the present invention is not restricted to that of the embodiments described above.

Although the invention has been described in its preferred form with a certain degree of particularity, obviously many changes and variations are possible therein. It is therefore to be understood that the present invention may be practiced otherwise than as specifically described herein without departing from the scope and spirit thereof.

We claim:

1. An ink jet recording head comprising:

an ink passage unit formed by superposing a nozzle plate, an ink passage plate and a cover plate, the nozzle plate having a plurality of nozzles, the ink passage plate having a first surface and a second surface which are opposite to each other and having a plurality of pressure producing chambers connected to the nozzles respectively and having an ink reservoir communicating with the pressure producing chambers via a plurality of ink inlet ports, the cover plate being joined to the first surface of the ink passage plate; and a pressure generator for applying pressure to an ink in the pressure producing chambers;

the ink passage plate comprising a first sheet having the first surface and a second sheet having the second surface, the first sheet and the second sheet being superposed, the second sheet being made of a metal sheet having the second surface and a third surface opposite to each other, the first sheet having a plurality of through holes corresponding to the pressure producing chambers, a through hole corresponding to the reservoir, and a plurality of through holes for forming the ink inlet ports, the ink inlet ports being shaped and arranged to allow the through holes corresponding to the pressure producing chambers to communicate with the through hole corresponding to the reservoir, the second sheet having a plurality of recesses forming the pressure producing chambers and a through hole forming the reservoir, the through hole forming the reservoir being formed from the second surface to the third surface in the metal sheet, the recesses forming the pressure producing chambers being formed in the third surface of the metal sheet by press working, the recesses forming the pressure producing chambers being connected to the through holes corresponding to the pressure producing chamber, the through hole forming the reservoir being connected to the through hole corresponding to the reservoir, and a protuberance-forming recess being formed in the second surface of the metal sheet by the press working so that portions surrounding the recesses forming the pressure producing chambers protrude when the recesses forming the pressure producing chambers are formed in the third surface of the metal sheet by the press working.

2. The ink jet recording head according to claim 1, wherein the third surface of the metal sheet is flattened by a flattening process after the press working.

3. The ink jet recording head according to claim 1, wherein a plurality of the protuberance-forming recesses formed in the second surface of the metal sheet are formed in a plurality of regions corresponding to a plurality of walls separating the adjacent pressure producing chambers respectively.

4. The ink jet recording head according to claim 1, wherein a plurality of the protuberance-forming recesses formed in the second surface of the metal sheet are formed in a plurality of regions extending across the pressure producing chambers and a plurality of walls separating the adjacent pressure producing chambers respectively.

5. The ink jet recording head according to claim 1, wherein the protuberance-forming recess formed in the second surface of the metal sheet is formed in a single region corresponding to all of the pressure producing chambers.

6. The ink jet recording head according to claim 1, wherein the metal sheet is a sheet of pure nickel, a ternary alloy of zinc, aluminum and copper, or a superplastic alloy of lead, tin and bismuth.

7. The ink jet recording head according to claim 1, wherein the ink passage plate is provided with ink outlet holes in portions of bottom walls of the pressure producing chambers corresponding to the nozzles so as to connect the pressure producing chambers to the nozzles respectively.

8. The ink jet recording head according to claim 1, wherein the cover plate is an elastic plate which is capable of being deformed at least in portions corresponding to the pressure producing chambers respectively, and the pressure generator includes a plurality of piezoelectric vibrators which are capable of deforming the elastic plate.

* * * * *